US011707749B2

(12) United States Patent
Morita

(10) Patent No.: US 11,707,749 B2
(45) Date of Patent: Jul. 25, 2023

(54) CENTRIFUGE INCLUDING ROTATABLE BOWL AND CONICAL SEPARATION DISCS ARRANGED IN THE BOWL

(71) Applicant: TOMOE ENGINEERING CO., LTD., Tokyo (JP)

(72) Inventor: Kenji Morita, Yokohama (JP)

(73) Assignee: TOMOE ENGINEERING CO., LTD., Tokyo (JP)

( * ) Notice: Subject to any disclaimer, the term of this patent is extended or adjusted under 35 U.S.C. 154(b) by 381 days.

(21) Appl. No.: 16/955,688

(22) PCT Filed: Dec. 4, 2018

(86) PCT No.: PCT/JP2018/044448
§ 371 (c)(1),
(2) Date: Jun. 18, 2020

(87) PCT Pub. No.: WO2019/124041
PCT Pub. Date: Jun. 27, 2019

(65) Prior Publication Data

US 2020/0306767 A1 Oct. 1, 2020

(30) Foreign Application Priority Data

Dec. 19, 2017 (JP) ..... 2017-242969

(51) Int. Cl.
*B04B 1/08* (2006.01)
*B04B 9/00* (2006.01)
(Continued)

(52) U.S. Cl.
CPC ..... *B04B 1/08* (2013.01); *B04B 9/00* (2013.01); *B04B 11/04* (2013.01); *B04B 13/00* (2013.01); *B04B 15/02* (2013.01)

(58) Field of Classification Search
CPC .. B04B 1/08; B04B 9/00; B04B 11/04; B04B 13/00; B04B 1/14; B04B 9/12; B04B 15/02
(Continued)

(56) References Cited

U.S. PATENT DOCUMENTS 4,654,023 A * 3/1987 Foldhazy ..... F16J 15/34 277/362
6,155,574 A * 12/2000 Borgstrom ..... B04B 9/12 277/928
(Continued)

FOREIGN PATENT DOCUMENTS

JP 59137460 U 9/1984
JP H0649164 B2 6/1994
(Continued)

OTHER PUBLICATIONS

International Search Report (ISR) (and English translation thereof) dated Feb. 26, 2019 issued in International Application No. PCT/JP2018/044448.
(Continued)

*Primary Examiner* — Charles Cooley
(74) *Attorney, Agent, or Firm* — Holtz, Holtz & Volek PC

(57) ABSTRACT

A disc-type centrifuge is configured to use clean water as sealing water to be supplied at high pressure to a sealing mechanism unit. A pump is disposed on a circulation pathway connecting a sealing water tank, in which the sealing water is stored, and the sealing mechanism unit. The sealing water (clean water) is circulated between the sealing water tank and the sealing mechanism unit by the pump. The pump is connected to the drive shaft of a motor that supplies a driving force to a rotating shaft and bowl and is configured so that the pump is operated by receiving the driving force of the motor.

7 Claims, 2 Drawing Sheets

(51) Int. Cl.
*B04B 11/04* (2006.01)
*B04B 13/00* (2006.01)
*B04B 15/02* (2006.01)

(58) Field of Classification Search
USPC ..... 494/38–41
See application file for complete search history.

(56) References Cited

U.S. PATENT DOCUMENTS

| | | | | |
|---|---|---|---|---|
| 7,594,757 | B2 * | 9/2009 | Verhaegen | H02K 5/1732 384/313 |
| 7,874,973 | B2 * | 1/2011 | Akatsu | B04B 15/06 494/60 |
| 7,901,342 | B2 * | 3/2011 | Tobita | B04B 15/00 494/25 |
| 7,909,751 | B2 * | 3/2011 | Tobita | B04B 15/02 494/37 |
| 9,238,233 | B2 * | 1/2016 | Morita | B04B 1/20 |
| 9,644,636 | B2 | 5/2017 | Hashimoto et al. | |
| 10,173,227 | B2 * | 1/2019 | Eliasson | B04B 9/12 |
| 10,357,787 | B2 | 7/2019 | Thorwid et al. | |
| 10,427,171 | B2 | 10/2019 | Thorwid et al. | |
| 10,639,648 | B2 * | 5/2020 | Ostkamp | F16C 33/6659 |
| 2012/0040816 | A1 | 2/2012 | Thorwid et al. | |
| 2015/0330401 | A1 | 11/2015 | Hashimoto et al. | |
| 2016/0074880 | A1 | 3/2016 | Thorwid et al. | |
| 2020/0306767 | A1 * | 10/2020 | Morita | B04B 1/14 |

FOREIGN PATENT DOCUMENTS

| | | | |
|---|---|---|---|
| JP | H07103338 | A | 4/1995 |
| JP | 2001219096 | A | 8/2001 |
| JP | 2011099532 | A | 5/2011 |
| JP | 2012519581 | A | 8/2012 |
| JP | 2013181609 | A | 9/2013 |

OTHER PUBLICATIONS

Written Opinion dated Feb. 26, 2019 issued in International Application No. PCT/JP2018/044448.

* cited by examiner

CENTRIFUGE INCLUDING ROTATABLE BOWL AND CONICAL SEPARATION DISCS ARRANGED IN THE BOWL

TECHNICAL FIELD

The present invention relates to a disc-type centrifuge that has a lot of conical separation discs stacked and arranged in a bowl and is configured to separate processing objects by rotating these discs at high speed.

BACKGROUND ART

As a centrifuge for separating processing objects using a centrifugal force, there has been known a centrifuge (disc-type centrifuge) that has a lot of conical separation discs stacked and arranged in a bowl and applies a centrifugal force to processing objects by rotating these discs at high speed. Such a disc-type centrifuge is capable of securing an extremely large sedimentation area with respect to the installation area by stacking a lot of separation discs at small intervals, and performing separation processing of a large amount of processing objects in a short period of time.

There exists a conventional disc-type centrifuge in which a rotating shaft is held vertically and a bowl for separating processing objects is configured to rotate about the vertical axis at high speed, the conventional disc-type centrifuge being configured such that the gap between the space in a casing in which the bowl is disposed and a frame supporting the rotating shaft is shaft-sealed by a mechanical sealing mechanism to prevent bacteria and foreign matter from entering the space inside the casing or to prevent the processing objects (separated solids, etc.) from leaking from the space inside the casing (for example, Patent Document 1).

More specifically, the mechanical sealing mechanism described in Patent Document 1 includes a rotating ring fixed to the rotating shaft, a fixed ring held so as not to come into contact with the rotating shaft, and a sealing housing, in which sealing water (external fluid) flows in quantitatively from a supply path into the region sealed by the sealing housing (space inside a small chamber surrounded by the rotating ring, the fixed ring, and the sealing housing), and at the same time the same amount of sealing water flows out from a discharge path on the opposite side, and the pressure inside the small chamber of the sealing housing is kept higher than the pressure inside the casing by adjusting the pressure on the discharge side, thereby realizing high sealing performance.

Patent Document 1: JP H06-49164 B

SUMMARY OF INVENTION

Technical Problem

In the sealing mechanism described in the Patent Document 1, pure water is used as the sealing water in order to prevent the entry of bacteria and foreign matter into the space inside the casing that uses the sealing water as a medium. The pure water discharged from the small chamber of the sealing housing is discarded directly without being reused. In such a case, however, a means for supplying the pure water in large amount (5 to 6 L/min) in a continuous manner during the operation of the disc-type centrifuge needs to be provided (such as a large-scale water purifying apparatus). Therefore, this sealing mechanism has a problem of having to have to secure a space for installing the water purifying apparatus and a problem of increased equipment installation costs and running costs.

The present invention was contrived in order to solve such problems of the prior art, and an object thereof is to provide a disc-type centrifuge that can have a simplified device configuration and reduced space, and significantly reduce equipment installation costs and running costs.

Solution to Problem

A disc-type centrifuge according to the present invention has a configuration in which a bowl is disposed in a casing, a lot of conical separation discs are arranged in the bowl in a stacked state at a predetermined interval, a tip of a rotating shaft held vertically penetrates the casing and is fixed to the bowl inside the casing, a sealing mechanism unit is disposed at the part where the rotating shaft penetrates the casing, processing objects introduced into the bowl are separated by a centrifugal force by rotating the rotating shaft and the bowl fixed to an upper end thereof at high speed, so that the processing objects can be discharged individually, wherein clean water is used as sealing water supplied to the sealing mechanism unit at high pressure, a pump is disposed on a circulation pathway that communicates the sealing mechanism unit with a sealing water tank in which the sealing water is stored, so that the pump circulates the sealing water between the sealing water tank and the sealing mechanism unit, and the pump is connected to a drive shaft of a motor supplying a driving force to the rotating shaft and the bowl, so that the pump is activated (an impeller inside a pump chamber rotates) in response to the driving force of the motor.

It is preferred that the sealing water tank is provided with a purifying device (a simple filter such as a Y-type strainer) so that the circulating sealing water is maintained at a predeterminded degree of cleanliness. It is also preferred that the pump and the drive shaft of the motor supplying a driving force to the pump are dynamically connected by means of a magnet drive method.

It is preferred that the disc-type centrifuge comprises a water supply device that supplies the bowl with operating water for opening and closing a valve when discharging solids from the bowl, and a operating water tank that stores the operating water and supplies the operating water to the water supply device, wherein water is supplied from the operating water tank to the sealing water tank, when the sealing water leaks. Further, it is preferred that heat exchange is performed between the operating water stored in the operating water tank and the sealing water in the sealing water tank so that the sealing water is cooled by the operating water.

In addition, an outer shell portion can be provided outside the sealing water tank, and the sealing water tank and the sealing water stored therein can be cooled by causing a refrigerant (preferably high-pressure air) to flow into a region between the sealing water tank and the outer shell portion. Alternatively, a temperature sensor can be installed in the sealing water tank, and when the water temperature exceeds a specified value, a specified amount of sealing water can be discarded from the sealing water tank, and water can be supplied from the operating water tank or other supply source into the sealing water tank.

Advantageous Effects of Invention

Since the disc-type centrifuge according to the present invention is configured in such a manner that the sealing water circulates between the sealing water tank and the sealing mechanism unit, it is not necessary to provide a water purifying apparatus or the like, which eventually not only accomplishes a simplified device configuration and reduced space but also significant decrease in equipment introduction costs and running costs. The pump for circulating the sealing water is connected to the drive shaft of the motor supplying a driving force to the rotating shaft and the bowl, and is configured in such a manner that the impeller inside the pump chamber rotates in response to the driving force of the motor. Thus, it is not necessary to separately prepare a driving force source for operating the pump, contributing to simplification of the device configuration.

Dynamically connecting the impeller inside the pump chamber to the drive shaft of the motor supplying a driving force to the impeller by means of a magnet drive method, can favorably avoid contamination of the sealing water caused by the shaft-sealing portion and leakage of the sealing water from the shaft-sealing portion. In the configuration in which water is supplied from the operating water tank to the sealing water tank when the sealing water leaks from the sealing mechanism unit or etc., the water level in the sealing water tank can be controlled within a certain range. In the configuration in which heat exchange is performed between the operating water stored in the operating water tank and the sealing water in the sealing water tank, or in the configuration in which the refrigerant can be supplied to the region between the sealing water tank and the outer shell portion, a rise of the temperature of the sealing water due to the heat received from the casing side can favorably be suppressed.

DESCRIPTION OF EMBODIMENTS

Figure 1:
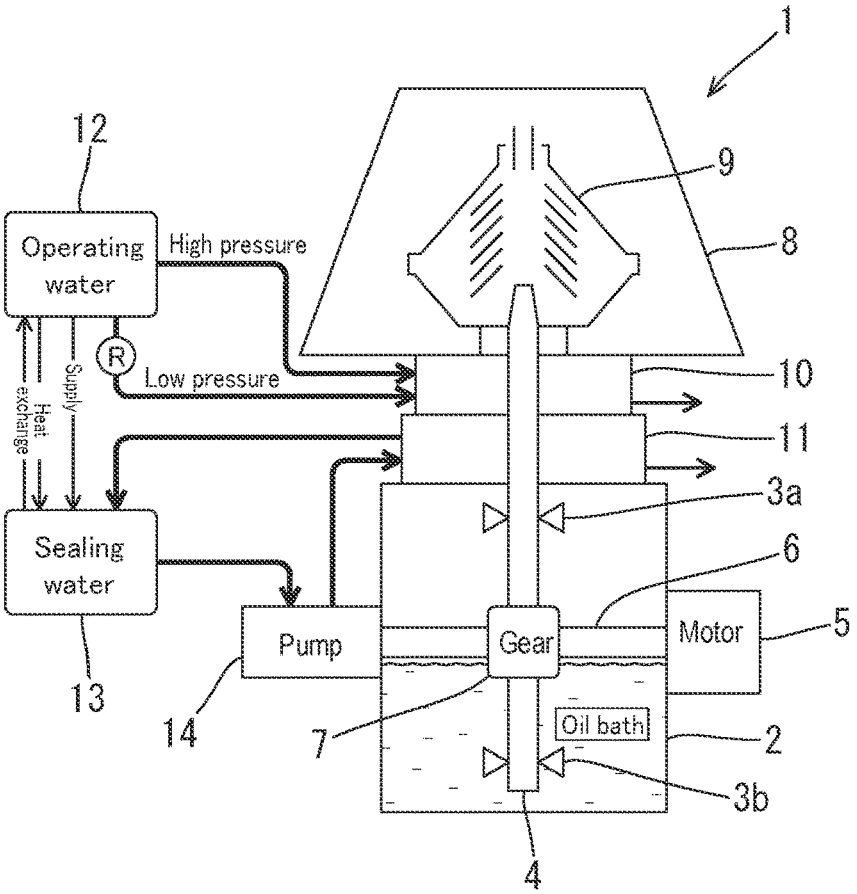
FIG. 1 is a diagram schematically showing a configuration of a disc-type centrifuge 1 according to the present invention.

The embodiments of the "disc-type centrifuge" of the present invention are now described hereinafter with reference to the accompanying drawings. FIG. 1 is a diagram schematically showing a configuration of a disc-type centrifuge 1 according to the present invention. As shown in the diagram, the disc-type centrifuge 1 has a rotating shaft 4 held vertically by upper and lower bearings 3*a*, 3*b* fixed to a frame 2.

This vertical rotating shaft 4 is dynamically connected to a horizontal drive shaft 6 (output shaft) of a motor 5 via a gear 7 and is configured to rotate at high speed in response to a driving force supplied from the motor 5. An upper part of the rotating shaft 4 enters a casing 8 from a lower opening thereof and is fixed to a bowl 9 inside the casing 8. The bearings 3*a*, 3*b*, a lower part of the rotating shaft 4, the drive shaft 6, and the gear 7 are housed in an oil box and lubricated by being splashed with oil stored in the oil box or droplets of the oil.

A lot of conical separation discs are arranged in a stacked state inside the bowl 9 (separation chamber). By rotating the rotating shaft 4 and the bowl 9 fixed to an upper end of the rotating shaft 4 at high speed, processing objects introduced into the bowl 9 can be separated by a centrifugal force (separated into liquid and solid, into light liquid and heavy liquid, or into light liquid, heavy liquid and solid) and discharged individually.

A water supply device 10 and the sealing mechanism unit 11 are disposed in the vicinity of the lower opening of the casing 8 through which the rotating shaft 4 passes. The water supply device 10 supplies operating water from a operating water tank 12 to the bowl 9 to open and close a valve when discharging solids from the bowl 9. The water supply device 10 is configured to instantaneously open the valve by supplying the bowl 9 with high-pressure operating water that is supplied from the operating water tank 12, so that the solids can be discharged from the inside of the bowl 9. By closing the valve (pressing the valve in a closing direction) by supplying the bowl 9 with low-pressure operating water (which is supplied from the operating water tank 12 through a pressure-reducing valve) from the water supply device 10, the valve can be sealed so that the solids are not discharged from the bowl 9.

The operating water supplied from the water supply device 10 to the bowl 9 is discharged (consumed) from the bowl 9 when the valve is operated, as a result, the water level in the operating water tank 12 is lowered. When the water level drops below a specific level, water is supplied from a supply source into the operating water tank 12 as appropriate in response to information from a water level sensor installed in the operating water tank 12. Furthermore, the operating water tank 12 is pressurized by supply of instrumentation air (compressed air) so that the operating water can be supplied at a predetermined pressure.

The sealing mechanism unit 11 is configured to shaft-seal the gap between the inside and the outside of the casing 8 in which the bowl 9 is disposed. In other words, the sealing mechanism unit 11 is configured to prevent bacteria and foreign matter from entering the space inside the casing 8 or processing objects (separated solids, etc.) from leaking from the space inside the casing 8, through the gap between an inner peripheral surface of the lower opening of the casing 8 and an outer peripheral surface of the rotating shaft 4.

Figure 2:
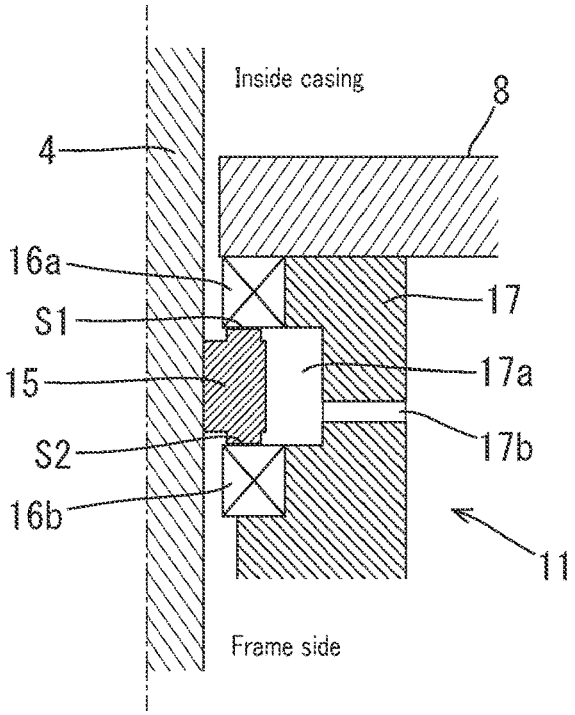
FIG. 2 is a partial cross-sectional view of a sealing mechanism unit 11 shown schematically in FIG. 1.

FIG. 2 is a partial cross-sectional view of the sealing mechanism unit 11. As shown in FIG. 2, the sealing mechanism unit 11 is composed of a mechanical sealing mechanism including a rotating ring 15 (seal ring), upper and lower fixed rings 16*a*, 16*b*, and a sealing housing 17. More specifically, the rotating ring 15 is fixed to the outer peripheral surface of the rotating shaft 4 and configured to rotate together with the rotating shaft 4, and the fixed rings 16*a*, 16*b* are each held in such a manner as to be movable in an axial direction of the rotating shaft 4 at a position where the fixed rings 16*a*, 16*b* do not come into contact with the outer peripheral surface of the rotating shaft 4.

The upper fixed ring 16*a* is energized downward (toward the rotating ring 15) by an energizing mean (such as springs), not shown, whereas the lower fixed ring 16*b* is similarly energized upward (toward the rotating ring 15) and pressed against, and comes into sliding contact with, the rotating ring 15 in a surface perpendicular to the axis of the rotating shaft 4 (contact surfaces S1, S2).

The sealing housing 17 is configured to seal a region outside the rotating ring 15 (out of two regions separated by the contact surface S1, the region opposite to the region inside the casing 8). In the region sealed by the sealing housing 17 (the space inside a small chamber 17*a* surrounded by the rotating ring 15, the fixed rings 16*a*, 16*b*, and the sealing housing 17), sealing water (clean water) is supplied from a supply path 17*b* formed in the sealing housing 17, at a pressure higher than the pressure inside the casing 8, thereby preventing, as much as possible, foreign matter from being mixed into the space inside the casing 8 and the processing objects (separated solids, etc.) from leaking out of the space inside the casing 8.

In the conventional sealing mechanism for sealing the rotating shaft of the disc-type centrifuge, as described above, since pure water is used as the sealing water and is discarded after use (after being discharged from the small chamber of the sealing housing), a large-scale water purifying apparatus or the like is required, bringing about such problems as installation space and increased equipment installation costs and running costs. On the other hand, in the disc-type centrifuge 1 of the present embodiment, clean water is used as the sealing water (water that is purified from raw water, such as tap water, to a predetermined level by a purifying device), and the sealing water circulates between the sealing water tank 13 and the sealing mechanism unit 11 as shown in FIG. 1. For this reason, a water purifying apparatus and the like do not need to be provided. Therefore, not only is it possible to simplify the device configuration and reduce the space, but also the equipment installation costs and running costs can be reduced significantly.

More specifically, as shown in FIG. 1, a pump 14 is disposed on a circulation pathway (closed pipeline) communicating the sealing water tank 13 with the sealing mechanism unit 11, wherein when the pump 14 is activated, the sealing water stored in the sealing water tank 13 is supplied to the sealing mechanism unit 11 and flows from the supply path 17*b* shown in FIG. 2 into the small chamber 17*a*, and the same amount of sealing water flows out from a discharge path, not shown, and is returned from the sealing mechanism unit 11 to the sealing water tank 13 and circulates.

The sealing water tank 13 is provided with a purifying device (filter) so that the circulating sealing water is maintained at a predetermined degree of cleanliness. Furthermore, the inside of the sealing water tank 13 is pressurized by supply of instrumentation air (compressed air) so that the sealing water can be supplied to the small chamber 17*a* at a pressure higher than the pressure inside the casing 8.

The pump 14 for circulating the sealing water is connected to the drive shaft 6 of the motor 5 supplying a driving force to the rotating shaft 4 and the bowl 9, and is configured in such a manner that an impeller inside a pump chamber rotates in response to the driving force of the motor 5. In the pump 14 used in the present embodiment, the impeller inside the pump chamber and the drive shaft 6 of the motor 5 supplying a driving force to the impeller are connected dynamically by means of a magnet drive method.

Specifically, while a typical pump has a structure in which a drive shaft for supplying a driving force to an impeller inside a pump chamber penetrates a partition from the outside the pump chamber and is connected to the impeller, wherein the penetrating portion of the drive shaft is shaft-sealed, the pump 14 used in the present embodiment does not have a drive shaft that penetrates a partition of the pump chamber and therefore does not have a shaft-sealing portion of the drive shaft. Therefore, contamination of the sealing water caused by the shaft-sealing portion and leakage of the sealing water to the outside can favorably be prevented.

Since the sealing water circulates in the closed pipeline, the water level of the sealing water in the sealing water tank 13 is basically constant. However, when the sealing water leaks from the sealing mechanism unit 11 or etc., and the water level in the sealing water tank 13 falls below a specified level, water is supplied from the operating water tank 12 to the sealing water tank 13 in response to information from a water level sensor installed in the sealing water tank 13. Further, when the sealing water passes through the sealing mechanism unit 11, there is a possibility that the temperature of the sealing water rises due to the heat received from the casing 8 side. In the present embodiment, however, heat exchange takes place between the operating water stored in the operating water tank 12 and the sealing water in the sealing water tank 13, thereby cooling the sealing water.

Moreover, in the present embodiment, it is configured such that the motor 5 and the drive shaft 6 are held horizontally, and the driving force of the motor 5 is transmitted to the vertical rotating shaft 4 via the gear 7. Further, it is configured such that the pump 14 circulating the sealing water is connected to the drive shaft 6 of the motor 5 supplying a driving force to the rotating shaft 4 and the bowl 9, and the impeller inside the pump chamber rotates in response to the driving force of the motor 5. However, the motor 5 and the drive shaft 6 may be held vertically, coupled directly to the vertical rotating shaft 4 (or connected via a gear drive mechanism, a belt drive mechanism, or the like), and connected to the pump 14.

Figure 3:
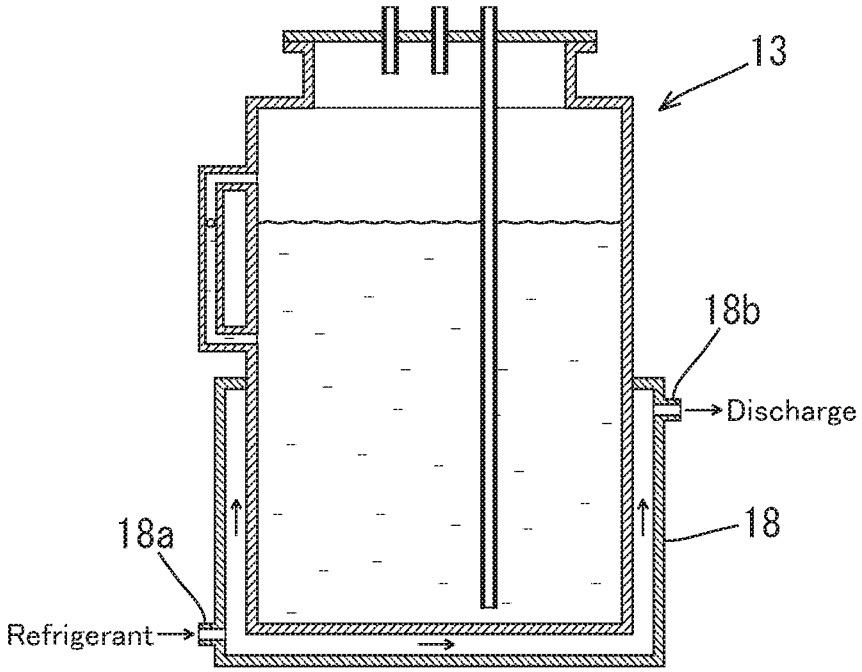
FIG. 3 is a cross-sectional view showing another configuration example of a sealing water tank 13 used in the disc-type centrifuge 1 according to the present invention.

In addition, in the present embodiment, the sealing water is cooled by performing heat exchange between the operating water stored in the operating water tank 12 and the sealing water in the sealing water tank 13, but as shown in FIG. 3, an outer shell portion 18 (cooling jacket) may be provided outside a lower half of the sealing water tank 13, and a refrigerant (high-pressure air or the like) may be let flow from a refrigerant inlet 18*a* into the region between the sealing water tank 13 and the outer shell portion 18, and discharged from a refrigerant outlet 18*b* on the opposite side, thereby cooling the sealing water tank 13 and the sealing water stored therein.

A simple cold air generator or the like to which the principle of vortex theory is applied can favorably be used as a source of supply of the refrigerant, which can reduce the equipment installation costs and save the installation space more than when cooling the sealing water by means of the heat exchange with the operating water (see FIG. 1). When the sealing water leaks from the sealing mechanism unit 11 or etc., and the water level in the sealing water tank 13 falls below the specified level, an alarm can be issued according to information from the water level sensor installed in the sealing water tank 13, and in this case, occurrence of abnormality can be managed.

Furthermore, a temperature sensor may be installed in the sealing water tank 13 to monitor the water temperature, and when the water temperature exceeds a specified value (e.g., 50° C.), a routine in which a specified amount of sealing water is discarded from the sealing water tank 13 and water (cold water) is supplied from the operating water tank 12 (or another supply source) may be automatically executed. In this case, the sealing water tank 13 needs to be provided with a level sensor (for high level and low level) in addition to the temperature sensor, which increases the costs more than in the foregoing embodiment, but the consumption of the sealing water can be minimized.

REFERENCE SIGNS LIST

1: Disc-type centrifuge
2: Frame
3*a*, 3*b*: Bearing
4: Rotating shaft
5: Motor

6: Drive shaft
7: Gear
8: Casing
9: Bowl
10: Water supply device
11: Sealing mechanism unit
12: Operating water tank
13: Sealing water tank
14: Pump
15: Rotating ring
16*a*, 16*b*: Fixed ring
17: Sealing housing
17*a*: Small chamber
17*b*: Supply path
18: Outer shell portion
18*a*: Refrigerant inlet
18*b*: Refrigerant outlet
S1, S2: Contact surface

The invention claimed is:

1. A centrifuge comprising:

a bowl disposed in a casing;

a plurality of conical separation discs arranged in the bowl in a stacked state;

a vertical rotating shaft having a tip that penetrates the casing and is fixed to the bowl inside the casing; and a sealing mechanism unit is disposed where the vertical rotating shaft penetrates the casing, wherein:

the centrifuge is configured to separate processing objects introduced into the bowl by centrifugal force by rotating the vertical rotating shaft and the bowl fixed thereto, so that the processing objects can be discharged individually, clean water is used as sealing water supplied to the sealing mechanism unit at high pressure, a pump is disposed on a circulation pathway that communicates the sealing mechanism unit with a sealing water tank in which the sealing water is stored, so that the pump circulates the sealing water between the sealing water tank and the sealing mechanism unit, and the pump is connected to a drive shaft of a motor supplying a driving force to the vertical rotating shaft and the bowl, so that the pump is activated in response to the driving force of the motor.

2. The centrifuge according to claim 1, wherein the sealing water tank is provided with a purifying device to clean the circulating sealing water.

3. The centrifuge according to claim 1, wherein the pump and the drive shaft of the motor supplying the driving force to the pump are connected dynamically by a magnet drive mechanism.

4. The centrifuge according to claim 1, further comprising a water supply device that supplies the bowl with operating water for opening and closing a valve when discharging solids from the bowl, and an operating water tank that stores the operating water and supplies the operating water to the water supply device, wherein water is supplied from the operating water tank to the sealing water tank, when the sealing water leaks.

5. The centrifuge according to claim 4, wherein heat exchange is performed between the operating water stored in the operating water tank and the sealing water in the sealing water tank, so that the sealing water is cooled by the operating water.

6. The centrifuge according to claim 1, wherein an outer shell portion is provided outside the sealing water tank, and the sealing water tank and the sealing water stored therein are cooled by causing a refrigerant to flow into a region between the sealing water tank and the outer shell portion.

7. The centrifuge according to claim 1, wherein a water temperature sensor is installed in the sealing water tank, and when a water temperature exceeds a specified value, a specified amount of sealing water is discarded from the sealing water tank and new water is supplied to the sealing water tank.

* * * * *